US006616991B1

(12) United States Patent
Uto

(10) Patent No.: US 6,616,991 B1
(45) Date of Patent: Sep. 9, 2003

(54) INK JET RECORDING MATERIAL FOR NON-AQUEOUS INK

(75) Inventor: Tetsuya Uto, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/712,206

(22) Filed: Nov. 15, 2000

(30) Foreign Application Priority Data

Nov. 18, 1999 (JP) ..... 11-327836
Oct. 25, 2000 (JP) ..... 2000-325442

(51) Int. Cl.[7] ..... B41M 5/00
(52) U.S. Cl. ..... 428/32.24; 428/32.3
(58) Field of Search ..... 428/195, 492, 428/497, 500, 521, 522, 32.24, 32.3

(56) References Cited

U.S. PATENT DOCUMENTS 4,642,247 A * 2/1987 Mouri et al. ..... 427/214
6,245,422 B1 * 6/2001 Onishi et al. ..... 428/195
6,294,243 B1 * 9/2001 Nakamura ..... 428/195

FOREIGN PATENT DOCUMENTS

JP 10-250218 * 9/1998 ..... B41M/5/00

* cited by examiner

*Primary Examiner*—Bruce H. Hess
*Assistant Examiner*—B. Shewareqed
(74) *Attorney, Agent, or Firm*—Oblon, Spivak, McClelland, Maier & Neustadt, P.C.

(57) ABSTRACT

An ink jet recording material for a non-aqueous ink, comprising an ink-receiving layer provided on a support and a polymer soluble or swellable in a petroleum type high boiling solvent, wherein the polymer is a liquid rubber.

12 Claims, No Drawings

INK JET RECORDING MATERIAL FOR NON-AQUEOUS INK

BACKGROUND OF THE INVENTION

1. Field of the Invention

The present invention relates to an ink jet recording material for a non-aqueous ink used in a printer or plotter employing an ink jet recording system using a non-aqueous ink. Particularly, the present invention relates to an ink jet recording material for a non-aqueous ink, which contains a petroleum high boiling solvent and is excellent in an ink-absorbing property and a fixing property of the non-aqueous ink.

2. Prior Art

Heretofore, an aqueous ink, i.e. an ink having a coloring agent such as a dye or a pigment dispersed or dissolved in water or a mixture solvent of water and a hydrophilic solvent, was used in ink jet recording.

However, the ink jet recording using an aqueous ink caused various problems since a printed part of the recording material extended by absorbing a solvent in the ink. The extension of the recording material was caused since hydrogen bonds between fibers maintaining a mechanical strength of a support were cut by the solvent in the aqueous ink, particularly water, and the extension of the recording material not only provided a bad influence on conveyance of the recording material within a printer but also degraded an accuracy of a relative position between the recording material and a print head, thereby causing unpreferable phenomena including a degradation of a size accuracy of a drawing obtained therefrom and unevenness of an image.

In order to solve these problems, JP-A-57-10660, JP-A-57-10661, JP-A-5-202324 and JP-A-5-331397 propose to use an ink having a coloring agent dissolved or dispersed in a non-aqueous solvent such as an isoparaffinic hydrocarbon. According to these inventions, a recorded material does not extend, and it is possible to carry out ink jet recording with a high size accuracy and without producing uneven images. Also, a non-aqueous solvent is characterized by having a low viscosity and a low surface tension, and it is therefore possible for the non-aqueous solvent to carry out a very high speed ink jet recording by raising a driving frequency of a print head as compared with an ink jet recording using an aqueous ink.

As a recording material used in an ink jet recording employing such a non-aqueous ink, JP-A-64-24785 discloses a recording material comprising an oil-absorbing inorganic pigment, an organic pigment and an aqueous adhesive, and JP-A-1-255580 discloses a recording material comprising silica and an adhesive. These recording materials have a recording surface of mat appearance, and are a mat coat type recording material.

On the other hand, in accordance with recent improvement of an ink jet printer, it has become possible to obtain a highly precise image comparable to a silver salt photograph. Thus, an ink jet recording material having a quality similar to silver salt photograph printing, i.e. having a satisfactory glossy surface, is demanded. As a matter of fact, these recording materials are required to have not only a satisfactory gloss but also a high recorded image density and a high precision of a recorded image. That is, they are required to have a smooth periphery around each dot and a clear outline, and also required not to cause cissing or flowing of an ink, and further required to have an excellent preservability of an image, i.e. a high fixing property of a coloring agent.

In order to satisfy these requirements, with regard to ink jet recording using an aqueous ink, JP-A-63-265680 and JP-A-5-59694 propose an ink jet recording material having a coating layer provided by cast coat method. Also, JP-A-6-155892 discloses a recording material having a film of a water-soluble polymer such as polyvinyl alcohol formed on a similar recording material. Further, JP-A-6-199035 discloses a recording material having an ink-receiving layer comprising pseudoboehmite provided on a support. According to these inventions, an ink jet recording material having a high gloss and a high absorptivity of an aqueous ink is provided. However, when these recording materials are used for recording a non-aqueous ink, a distribution of a coloring agent in a recording material becomes uneven and therefore there are provided various defects of producing a low image density, causing cissing of an ink on the surface of a recording material, thereby to produce uneven images and causing falling off of a coloring agent in the printed part even by a slight friction since there is no affinity between a material for forming a recording material and a coloring agent or a solvent contained in an ink. Thus, when a non-aqueous ink was printed on these recording material, it was quite impossible to obtain a satisfactory recorded image having a high density, a high precision and an excellent preservability.

As a recording material to be used in ink jet recording employing a non-aqueous ink for solving these problems, JP-A-10-250218 discloses a recording material providing a satisfactory recorded image of high precision and a satisfactory fixing property of a coloring agent by incorporating a polymer soluble in an isoparaffinic hydrocarbon into a coating layer. The polymer soluble in the isoparaffinic hydrocarbon contained in the coating layer is dissolved in a solvent in the ink after printing and traps a coloring agent therein. Thereafter, the solvent loses fluidity by drying, and fixes the coloring agent therein, thereby enabling to make the coloring agent uniformly distribute in the inside of the recording material, to improve a density and a precision, and also to improve a fixing property of the coloring agent to the recording material. However, depending on a type of an ink used for printing, there was a fear of producing a difference in a fixing property of a coloring agent to a recording material due to a difference in an affinity to an ink.

Thus, an object of the present invention is to provide an ink jet recording material for a non-aqueous ink used in a printer or plotter employing an ink jet recording system, characterized by having a satisfactory fixing property and a satisfactory ink-absorbing property of the non-aqueous ink and also having a satisfactory long term preservability of a white paper part (resistance to yellow coloration).

The objection of the present invention can be achieved by providing the following means.

SUMMARY OF THE INVENTION

The present invention provides an ink jet recording material for a non-aqueous ink, having a satisfactory fixing property of the non-aqueous ink and a satisfactory ink-absorbing property, which comprises an ink-receiving layer formed on a support, the ink-receiving layer containing a polymer soluble or swellable in a petroleum high boiling solvent, wherein the polymer is a liquid rubber.

Also, the present invention provides a glossy ink jet recording material for a non-aqueous ink, having a satisfactory fixing property of the non-aqueous ink and a satisfactory ink-absorbing property, wherein the outermost layer of an ink-receiving layer is a gloss-developing layer.

The non-aqueous ink-absorbing property and the fixing property of the ink jet recording material for a non-aqueous ink are more improved by employing a liquid polyisoprene or a liquid polyisobutylene as the rubber contained in the ink-receiving layer.

Also, the non-aqueous ink-absorbing property, fixing property and preservability of a white paper portion of the ink jet recording material for a non-aqueous ink are further improved by employing a hydrogenated liquid polyisoprene as the liquid rubber contained in the ink-receiving layer.

Also, it is preferable to impregnate an ink-receiving layer with a solution of a liquid rubber by coating the solution on the ink-receiving layer. By concentrating the liquid rubber on the surface part of a recording material, an effect archived by incorporating the liquid rubber is more improved.

DETAILED DESCRIPTION OF THE INVENTION

Hereinafter, the present invention is further described in more details by referring to preferable embodiments.

According to the present invention, an ink jet recording material for a non-aqueous ink is an ink jet recording material for a non-aqueous ink comprising an ink-receiving layer provided on a support and a polymer (hereinafter referred to as "solvent-soluble polymer") soluble or swellable in a petroleum high boiling solvent contained in the ink-receiving layer, characterized in that the solvent-soluble polymer is a liquid rubber.

The liquid rubber as the solvent-soluble polymer provides an excellent ink-absorbing property and achieves an effect of improving a fixing property of a non-aqueous ink by being dissolved in a solvent contained in the ink after printing, trapping a coloring agent, losing its fluidity by drying the solvent and fixing the coloring agent in the inside, thereby uniformly distributing the coloring agent within the recording material. Further, since the liquid rubber is a viscous liquid at normal temperature, it works as a viscosity-imparting agent and strongly fixes a coloring agent, and can effectively improve the fixing property of a non-aqueous ink.

Examples of the liquid rubber as a solvent-soluble polymer in the present invention include liquid BR, liquid SBR, liquid NBR, liquid polychloroprene, liquid polysulfide, liquid natural rubber, liquid polyisoprene, liquid butyl rubber, liquid polyisobutylene, liquid $C_5$ system polymer, liquid polyolefin, and the like, and their modified products and copolymers of monomers used for these polymers are also usable.

The liquid rubber used in the present invention is not limited to the above illustrated materials, but among these rubbers, liquid polyisoprene or liquid polyisobutylene is particularly preferable in respect of fixing property and ink-absorbing property of a non-aqueous ink since it has an excellent solubility in a petroleum high boiling solvent or well swellable in this solvent. Examples of the petroleum high boiling solvent used as a solvent for a non-aqueous ink include isoparaffin, paraffin, and the like.

The liquid rubber used in the present invention has preferably no unsaturated double bond in its molecular structure. For example, among liquid polyisoprenes, a liquid polyisoprene having an unsaturated double bond hydrogenated has excellent heat resistance and weather resistance since this type of liquid polyisoprene has less double bonds in the molecule. Therefore, as compared with an ink jet recording material for a non-aqueous ink which contains an ordinary liquid rubber in an ink-receiving layer, an ink jet recording material for a non-aqueous ink which contains a hydrogenated liquid polyisoprene in an ink-receiving layer, has an excellent resistance to light and heat, thereby providing a satisfactory recording material having an excellent preservability without causing color change of a white paper portion (coloration to yellow) even when storing for a long term.

In the ink jet recording material for a non-aqueous ink of the present invention, a method for impregnating a liquid rubber as a solvent-soluble polymer preferably comprises dissolving in an appropriate organic solvent and coating. By this method, it is possible to concentrate the liquid rubber on the surface portion of the recording material, thereby achieving more efficiently an effect of impregnating the liquid rubber.

In the ink jet recording material for a non-aqueous ink of the present invention, a coated amount of a solvent-soluble polymer to be impregnated into an ink-receiving layer is preferably from 0.3 to 15 g/m$^2$, more preferably from 3 to 10 g/m$^2$. If the coated amount is less than this range, it is difficult to strongly fix a coloring agent and the fixing property of the coloring agent becomes poor. On the other hand, if the coated amount is more than this range, an ink-absorbing rate becomes unsatisfactory and uneven images are produced.

Examples of a coating method of a liquid rubber as a solvent-soluble polymer include generally used coating methods employing a roll coater, an air knife coater, a blade coater, a rod coater, a bar coater, a gravure coater, a curtain coater and the like, but the present invention is not limited thereto.

In the present invention, an ink-receiving layer is provided on a support. The ink-receiving layer is a layer absorbing and retaining an ink and forming an image thereon, and is a porous layer comprising a pigment as the main component.

The pigment used in the ink-receiving layer may be at least one of well known pigments. Examples of the pigment include inorganic pigments such as light calcium carbonate, heavy calcium carbonate, kaolin, talc, calcium sulfate, barium sulfate, titanium dioxide, zinc oxide, zinc carbonate, titan white, aluminum silicate, diatomaceous earth, calcium silicate, magnesium silicate, synthetic amorphous silica, colloidal silica, colloidal alumina, pseudoboehmite, aluminum hydroxide, alumina, zeolite, magnesium carbonate, magnesium hydroxide and the like, and organic pigments such as styrene type plastic pigment, an acryl type plastic pigment, polystyrene, microcapsule, urea resin, melamine resin and the like. Among them, a porous inorganic pigment is preferable as a pigment contained as the main component in the ink-receiving layer, and preferable examples include porous synthetic amorphous silica, porous magnesium carbonate and porous alumina, and a porous synthetic amorphous silica having a large pore volume is particularly preferable.

Examples of a binder for the pigment used in the ink-receiving layer include starch and its modified product, gelatin and its modified product, natural high molecular resins such as casein, pullulan, gum Arabic, karaya gum, albumin and the like or their derivatives, polyvinyl alcohol or its cation-modified product or silanol-modified product, latexes such as SBR latex, NBR latex, methyl methacrylate-butadiene copolymer, ethylene-vinyl acetate copolymer, and the like, a vinyl polymer such as polyacrylamide, polyvinyl pyrrolidone or the like, polyethylene imine, polypropylene glycol, polyethylene glycol, a polymer or copolymer of maleic anhydride, and the like. They may be used alone or in a mixture of two or more.

In addition to a pigment and a binder, a coating solution for forming an ink-receiving layer may optionally contain a surfactant, a coloring dye, a coloring pigment, a cationic ink dye-fixing agent, a UV-ray absorber, an antioxidant, a dispersant for a pigment, a defoaming agent, a leveling agent, a rot-proofing agent, a fluorescent whitening agent, a viscosity stabilizer, a pH regulator, and other well known various additives.

A coated amount of an ink-receiving layer coating solution on a support is preferably from 3 to 30 $g/m^2$, more preferably from 10 to 20 $g/m^2$, in terms of solid content. If the coated amount is larger than this range, a drying property of the ink-receiving layer becomes poor.

The ink-receiving layer is formed by coating and drying by a coating apparatus. Examples of a coating method of a coating solution include slide hopper system, curtain system, extrusion system, air knife system, roll coating system, rod bar coating system, and other generally used coating methods.

A glossiness of the ink-receiving layer of the present invention can be raised by providing a gloss-developing layer comprising colloid particles as the outermost layer of the ink-receiving layer. The gloss-developing layer provides a solvent-absorbing property due to spaces present between colloid particles.

Examples of the colloid particles for forming the gloss-developing layer include various materials such as inorganic colloid particles including pseudoboehmite, alumina (hydrate) such as boehmite, silica, titania and the like. Among them, colloid particles such as alumina and silica are particularly preferable since they have a strong bonding force between colloid particles and provides a gloss-developing layer having a high mechanical strength.

Various methods are employed for forming a gloss-developing layer from such colloid particles. For example, a colloid particle dispersion such as alumina sol, silica sol or the like is coated alone or in a mixture with a binder on a support, and is then dried. Also, in addition to this method, after coating a coating solution of a gloss-developing layer, the coated surface is subjected to press-polishing by a planishing roll while it is in a wet state or after drying the coated surface and wetting again, thereby transferring the shape of the planishing roll surface to the gloss-developing layer. This method is so to speak "cast method", and provides a higher gloss than a method simply comprising coating and drying.

In the present invention, it is particularly referable to employ an ink-receiving layer having such a gloss-developing layer formed by this cast method. When using a liquid rubber which is a viscous liquid at room temperature as a solvent-soluble polymer to have the liquid rubber impregnated in the vicinity of the surface of a recording material, there is a case that an unpreferable adhesiveness occurs on the surface. However, by using an ink-receiving layer having a gloss-developing layer formed by the cast method, the above-mentioned unpreferable adhesiveness hardly occurs even by incorporating the liquid rubber, and it is not necessary to provide an adhesiveness-preventing layer which may give a bad influence on precision of recorded images.

This is probably because the gloss-developing layer formed by the cast method includes many crack-like pores, into which a solvent-soluble polymer penetrates. When the crack-like pores have a size in the range of from 50 nm to 5 $\mu$m in the width direction by observing with a scanning type electromicroscope, a gloss-developing layer provides a recording material having a satisfactory gloss and is hardly adhesive even when using a liquid rubber which is a liquid viscous at room temperature.

As a support used in the present invention, any substrate of a transparent or opaque material can be used. Examples of the support include a transparent film such as polyester, polysulfone, polyvinyl chloride, polycarbonate, polystyrene, polymethyl methacrylate, cellulose acetate, polyethylene, polypropylene or the like, or a whitened film or synthetic paper obtained by filling a white pigment or finely foaming, and further a general paper, a coated paper, a baryta paper, a resin-coated paper, and the like. Still further, any substrate such as glass, aluminum foil, deposited paper, deposited film, cloth or the like, on which an ink-receiving layer can be provided, is usable.

It is possible to have an anchor layer formed on a substrate for the purpose of improving adhesiveness. The anchor layer may contain a hydrophilic binder such as gelatin, a solvent-soluble binder such as polyvinyl butyral, a latex, a curing agent, a pigment, a surfactant or the like in an optional combination.

It is also possible to provide various back coat layers on the substrate of the present invention for imparting antistatic properties, carrying properties, curl-preventing properties, writability, sizing properties and the like. The back coat layer may contain an inorganic antistatic agent, an organic antistatic agent, a hydrophilic binder, a latex, a curing agent, a pigment, a lubricant, a surfactant or the like, in an optional combination.

As a non-aqueous ink used in the present invention, an ink having a coloring agent dissolved or dispersed in a non-aqueous solvent is used.

As the non-aqueous solvent, various solvents are selected so as to be suitable for performances of an ink jetting head of an ink jet recording apparatus or by considering safety, and plural kinds of solvents may be used in a mixture in some cases.

Typical examples of such solvents include petroleum naphtha type solvents such as Pegasol (manufactured by Mobil Petroleum Company), Shell SBR, Shellsol® (manufactured by Shell Petrochemical Company) and the like, aromatic petroleum solvents such as HISOL (manufactured by NIPPON PETROCHEMICALS CO., LTD.), aliphatic petroleum solvents such as Soltol (manufactured by Philips Petroleum Company) Exosol, ISOPAR® (manufactured by Exxon Chemical JAPAN INC.), IP solvent (manufactured by Idemitsu Petrochemical Co., Ltd.) and the like, naphthene type petroleum solvents such as Inksolvent (Mitsubishi Oil Co., Ltd.), and the like.

Examples of a coloring agent used in a non-aqueous ink include a solution or dispersion of an oil-soluble dye such as a naphthol dye, an azo dye, a metal complex salt dye, an anthraquinone dye, a quinoimine dye, an indigo dye, a cyanine dye, a quinoline dye, a nitro dye, a nitroso dye, a benzoquinone dye, a carbonium dye, a naphthoquinone dye, a naphthalimide dye, a phthalocyanine dye, a pellinine dye or the like, carbon blacks such as furnaced black, lamp black, acetyrene black, channel black or the like, an organic pigment such as orthonitroaniline black, toluidine red, permanent carmine FB, first yellow AAA, disazoorange PMP, lake red C, brilliant carmine 6B, phthalocyanine blue, quinacridone red, dioxane violet, pictria pure blue, alkali blue toner, first yellow 10G, orthonitroaniline orange, toluidine red, barium red 2B, calcium red 2B, pigment scarlet 3B lake, ansocine 3B lake, rhodamine 6G lake, methyl violet lake, basic blue 5B lake, first sky blue, alkali blue R toner, Prussian blue, ultramarine blue, reflex blue 2G, brilliant green lake, phthalocyanine green G, iron oxide powder, zinc white, calcium carbonate, clay, barium sulfate, alumina white, aluminum powder, daylight fluorescent pigment, pearl pigment, and the like, and other pigments obtained by surface-treating these pigments, but the pigment is not limited to the above illustrated examples.

Also, in order to improve preservation stability and resistance friction of printed images, a non-aqueous ink may further contain a polar resin such as polyacrylate, linseed oil-modified alkyd resin, polystyrene, rosin type resin, terpene phenol type resin, alkylphenol-modified xylene resin and the like, and additives such as a metal sealing agent, a surface tension adjuster, a surfactant, a viscosity adjuster, a defoaming agent, a foam-inhibitor, a release agent, a foaming agent, an introfier, a fluorescent whitening agent, a UV-ray absorber, a preservative, an anti-hydrating agent, a rheology modifier, an anti-oxidant, and the like, in an optional combination.

EXAMPLES

Hereinafter, the present invention is further illustrated in more details by referring to Examples, but the present invention should not be limited to the Examples. The term "part" used herein means "part by weight" unless otherwise specified.

(Preparation of Support)

5 Parts of a pigment (light calcium carbonate/heavy calcium carbonate/talc ratio=30/35/35), 0.1 part of a commercially available alkyl ketene dimmer, 0.03 part of a commercially available cationic polyacrylamide, 1.0 part of a commercially available cationized starch and 0.5 part of alumina sulfate were added to a wood pulp comprising 100 parts of LBKP of freeness 450 ml CSF, and the resultant mixture was made into a paper having a weight of 90 g/m$^2$ by a Fourdrinier paper machine to obtain a support.

(Preparation of Ink-receiving Layer A)

While stirring 580 parts of water, 150 parts of silica sol (Snowtex-O®: solid content 20%, manufactured by Nissan Chemical Industries), 100 parts of synthetic amorphous silica (Mizukasil P78F®: manufactured by Mizusawa Industrial Chemicals Ltd.), 2 parts of a fluorescent whitening agent (Kaycall BBL®: solid content 50%, manufactured by Nippon Soda Co., Ltd.), 250 parts of a 10% aqueous solution of polyvinyl alcohol (PVA-117: manufactured by Kuraray Co., Ltd.) and 50 parts of a dimethyl amine-epichlorohydrin condensate (CatiomasterPD-10®: solid content 50%, Yokkaichi Chemical Co., Ltd.) were blended therewith to prepare a coating solution.

The coating solution thus prepared was coated on the above prepared support by a wire bar so as to obtain a dry coated amount of 10 g/m$^2$, and was dried in a hot air drier at 120° C. to prepare "ink-receiving layer A".

(Preparation of Ink-receiving Layer B)

While stirring 285.5 parts of water, 250 parts of silica sol (Snowtex-O®: solid content 40%, manufactured by Nissan Chemical Industries), 62.5 parts of styrene-butadiene type latex (JSR-0691®: solid content 48%, manufactured by JSR Corporation) and 2 parts of a potassium oleate were blended therewith to prepare a coating solution.

The coating solution thus prepared was coated on the above prepared ink-receiving layer A by a wire bar so as to provide a dry coated amount of 3 g/m2, and was dried by pressing with a planish press roller having a surface temperature of 90° C. to prepare "ink-receiving layer B". The surface of the ink-receiving layer thus prepared was observed by a scanning type electromicroscope, and was found to have crack-like pores having a size of from 100 nm to 2.5 $\mu$m in the width direction.

Example 1

20 Parts of a liquid polybutadiene (Poly-bd R45HT: manufactured by Idemitsu Petrochemical Co., Ltd.) was dissolved in 80 parts of an isoparaffinic hydrocarbon solvent (Isopar G®: manufactured by Exxon Chemical JAPAN INC.) to prepare a coating solution. The coating solution thus prepared was coated on the above prepared "ink-receiving layer B" by a wire bar so as to provide a dry coated amount of 5 g/m$^2$ to obtain an ink jet recording material for a non-aqueous ink of Example 1.

Example 2

20 Parts of a liquid polyisoprene (Kuraprene LIR-30: manufactured by Kuraray Co., Ltd.) was dissolved in 80 parts of an isoparaffinic hydrocarbon solvent (Isopar G®: manufactured by Exxon Chemical JAPAN INC.) to prepare a coating solution. The coating solution thus prepared was coated on the above prepared "ink-receiving layer B" by a wire bar so as to provide a dry coated amount of 5 g/m$^2$ to obtain an ink jet recording material for a non-aqueous ink of Example 2.

Example 3

20 Parts of a liquid polyisobutylene (VISTANEX LMMS: manufactured by Exxon Chemical JAPAN INC.) was dissolved in 80 parts of an isoparaffinic hydrocarbon solvent (Isopar G®: Exxon Chemical JAPAN INC.) to prepare a coating solution. The coating solution thus prepared was coated on the above prepared "ink-receiving layer B" by a wire bar so as to provide a dry coated amount of 5 g/m$^2$ to obtain an ink jet recording material for a non-aqueous ink of Example 3.

Example 4

20 Parts of a liquid polyisobutylene (Tetrax 3T®: manufactured by NIPPON PETROCHEMICALS CO., LTD.) was dissolved in 80 parts of an isoparaffinic hydrocarbon solvent (Isopar G®: manufactured by Exxon Chemical JAPAN INC.) to prepare a coating solution. The coating solution thus prepared was coated on the above prepared "ink-receiving layer B" by a wire bar so as to provide a dry coated amount of 5 g/m$^2$ to obtain an ink jet recording material for a non-aqueous ink of Example 4.

Example 5

20 Parts of a hydrogenated liquid polyisoprene (KURAPRENE LIR-290®: Kuraray Co., Ltd.) was dissolved in 80 parts of an isoparaffinic hydrocarbon solvent (Isopar G®: manufactured by Exxon Chemical JAPAN INC.) to prepare a coating solution. The coating solution thus prepared was coated on the above prepared "ink-receiving layer B" by a wire bar so as to provide a dry coated amount of 5 g/m$^2$ to obtain an ink jet recording material for a non-aqueous ink of Example 5.

Example 6

The same procedure as in Example 5 was repeated to obtain an ink jet recording material for a non-aqueous ink of Example 6, except that the coating solution of Example 5 was coated on the above prepared "ink-receiving layer B" by a wire bar so as to provide a dry coated amount of 0.2 g/m$^2$.

Example 7

The same procedure as in Example 5 was repeated to obtain an ink jet recording material for a non-aqueous ink of Example 7, except that the coating solution of Example 5 was coated on the above prepared "ink-receiving layer A" by a wire bar so as to provide a dry coated amount of 5 g/m$^2$.

Comparative Example 1

100 Parts of xylene as a solvent was charged into a four-forked flask equipped with a stirrer, and was heated to 70° C. in a water bath while passing nitrogen therethrough. 5 Parts of 2,2'-azobis(2-methylbutylonitril) as a polymerization initiator was added thereto, and a mixture of 50 parts of lauryl methacrylate and 50 parts of isobornyl methacrylate was dropwise added thereto for 4 hours, and the resultant content was maintained at 70° C. for 4 hours after finishing the dropwise adding. Thereafter, the temperature was raised to 90° C., and was maintained at this temperature for 2 hours to obtain a polymer solution. The polymer solution thus obtained was thinly spread over a glass plate and was dried at 80° C., and the dry film thus obtained was separated and was dissolved in a 4 times weight of Isopar G® while stirring. The polymer solution thus obtained was evaporated to dryness in a rotary evaporator, and was then dissolved in Isopar G® to prepare a coating solution having a concentration of 20%. The coating solution thus prepared was coated on the above prepared "ink-receiving layer B" by a wire bar so as to provide a dry coated amount of 5 g/m$^2$ to obtain an ink jet recording material for a non-aqueous ink of Comparative Example 1.

Comparative Example 2

The same procedure as in Comparative Example 1 was repeated to obtain an ink jet recording material for a non-aqueous ink of Comparative Example 2, except that 100 parts of lauryl methacrylate was used as a monomer in place of the mixture of 50 parts of lauryl methacrylate and 50 parts of isobornyl methacrylate.

Comparative Example 3

The same procedure as in Example 1 was repeated to obtain an ink jet recording material for a non-aqueous ink of Comparative Example 3, except that a 10% aqueous solution of polyvinyl alcohol (PVA-117: Kuraray Co., Ltd.) was used as a coating solution in place of the coating solution used in Example 1.

Comparative Example 4

An ink jet recording material for a non-aqueous ink of Comparative Example 4 was obtained by using the above prepared "ink-receiving layer A" as it is.

Comparative Example 5

An ink jet recording material for a non-aqueous ink of Comparative Example 5 was obtained by using the above prepared "ink-receiving layer B" as it is.

Comparative Example 6

The same procedure as in Example 1 was repeated to obtain an ink jet recording material for a non-aqueous ink of Comparative Example 6, except that a 5% toluene solution of polyisoprene (KURAPRENE IR-10®: manufactured by KURARAY CO., LTD) as a solid rubber was used as a coating solution in place of the coating solution used in Example 1.

A square solid printed pattern was printed by an ink jet printer (PJ3600: manufactured by Olympus Optical Co., Ltd.) with a black ink on each ink jet recording material for a non-aqueous ink prepared in the above Examples 1 to 7 and Comparative Examples 1 to 6, and was evaluated by the following method, and the results are shown in the following Table 1.

(Evaluation Method)

"Glossiness" was evaluated by a glossmeter (GM-26D type, manufactured by MURAKAMI COLOR LABORATORY RESEARCH), and a 75° specular gloss (Gs) of an unprinted part was measured in accordance with JIS-Z-8741 method to express a glossiness.

(Fixing Property)

The evaluation of "fixing property" was made by rubbing the surface of a solid-printed part of black ink with an index finger for one time in one direction, and as this result, a sample wherein the coloring agent was not spread over a surrounding white paper (unprinted part) was evaluated that a fixing property was good and was expressed by a symbol mark "○", and a sample wherein the coloring agent was slightly spread but did not cause a substantial problem was evaluated that a fixing property was medium and was expressed by a symbol mark "Δ", and a sample wherein the coloring agent was separated from the surface was evaluated that a fixing property was bad and was expressed by a symbol mark "X".

(Adhesive Feeling)

The evaluation of "adhesive feeling" was made by rubbing a white paper part with a finger, and a sample wherein there was no adhesive feeling was evaluated to be good and was expressed by a symbol mark "○", and a sample wherein there was a slight adhesive feeling but did not cause any substantial problem was evaluated to be medium and was expressed by a symbol mark "Δ", and a sample wherein there was a substantial adhesive feeling was evaluated to be bad and was expressed by a symbol mark "X".

(Ink-absorbing Property)

The evaluation of "ink-absorbing property" was made by judging printed qualities after printing rectangular patterns of monocolor (each of cyan (C), magenta (M), and yellow (Y)), two colors (C+M, M+Y and Y+C) and three colors (C+M+Y) by an ink jet printer (PJ3600: manufactured by Olympus Optical Co., Ltd.).

A sample wherein an excellent printed image was obtained without causing ink bleeding at the three color-printed part, was evaluated to be "excellent" and was expressed by a symbol mark "◎".

A sample wherein an excellent printed image was obtained although a slight ink bleeding was observed at the three color-printed part, was evaluated to be "good" and was expressed by a symbol mark "○".

A sample wherein no substantial problem was caused but an ink bleeding was observed at the three color-printed part (C+M+Y) and a "shade" part in a photograph image became black and a fine image became vogue as compared with the sample "○", was evaluated to be "medium" and was expressed by a symbol mark "Δ".

A sample wherein an ink bleeding was observed at the two color-printed part and the printing quality was so bad as to cause a substantial problem, was evaluated to be "bad" and was expressed by a symbol mark "X".

TABLE 1

| | Ink-receiving layer | Polymer | Solvent-solubility | Glossiness | Fixing property | Adhesive feeling | Ink-absorbing property |
|---|---|---|---|---|---|---|---|
| Example 1 | B | Liquid polybutadiene | Soluble | 82.1 | ○ | ○ | ○ |
| Example 2 | B | Liquid polyisoprene | Soluble | 82.5 | ○ | ○ | ◎ |
| Example 3 | B | Liquid polyisobutylene | Soluble | 82.0 | ○ | ○ | ◎ |
| Example 4 | B | Liquid polyisobutylene | Soluble | 81.3 | ○ | ○ | ◎ |
| Example 5 | B | Hydrogenated liquid polyisoprene | Soluble | 81.9 | ○ | ○ | ◎ |
| Example 6 | B | Hydrogenated liquid polyisoprene | Soluble | 81.9 | Δ | ○ | ◎ |
| Example 7 | A | Hydrogenated liquid polyisoprene | Soluble | 15.5 | ○ | Δ | ◎ |
| Comparative Example 1 | B | Lauryl methacrylate 50 Isobornyl methacrylate 50 | Soluble | 81.3 | Δ | ○ | Δ |
| Comparative Example 2 | B | Stearyl methacrylate 100 | Soluble | 82.4 | Δ | Δ | Δ |
| Comparative Example 3 | B | Polyvinyl alcohol | Insoluble | 80.3 | x | ○ | x |
| Comparative Example 4 | A | None | — | 10.4 | Δ | ○ | x |
| Comparative Example 5 | B | None | — | 79.5 | x | ○ | x |
| Comparative Example 6 | B | Solid polyisoprene | Soluble | 80.8 | x | ○ | x |

Further, each ink jet recording material for a non-aqueous ink prepared in the same manner as in the above Examples 1 to 7 was evaluated in the following manner by printing a square solid-printed pattern by an ink jet printer (PJ3600: manufactured by Olympus Optical Co., Ltd.) with a black ink, and the results are shown in the following Table 2.

(Yellow Coloration)

The evaluation of "yellow coloration" was made by placing each ink jet recording material for a non-aqueous ink in a commercially available polypropyrene-made plastic file bag (A4 size), allowing to stand in a room for one month, taking out the recording material and measuring L*a*b* of a white paper part of the ink jet recording material for a non-aqueous ink by a color chrominance meter before and after the treatment. The degree of "yellow coloration" can be expressed by a difference in b*(Δb*) before and after the treatment, and when this value is smaller, coloration (yellow coloration) is considered to be smaller. A sample having a Δb* value of at most 1.2 is evaluated to be "excellent" and is expressed by a symbol mark "◎", and a sample having a Δb* value of at most 3 is evaluated to be "good" and is expressed by a symbol mark "○", and a sample having a Δb* value of from 3 to 5 is evaluated to be "medium" and is expressed by a symbol mark "Δ", and a sample having a Δb* value of at least 5 is evaluated to be "bad" and is expressed by a symbol mark "X".

TABLE 2

| | Ink-receiving layer | polymer | Yellow coloration | |
|---|---|---|---|---|
| Example 1 | B | Liquid polybutadiene | 8.43 | X |
| Example 2 | B | Liquid polyisoprene | 4.77 | Δ |
| Example 3 | B | Liquid polyisobutylene | 1.84 | ○ |
| Example 4 | B | Liquid polyisobutylene | 1.40 | ○ |
| Example 5 | B | Hydrogenated liquid polyisoprene | 1.03 | ◎ |
| Example 6 | B | Hydrogenated liquid polyisoprene | 1.03 | ◎ |
| Example 7 | A | Hydrogenated liquid polyisoprene | 1.06 | ◎ |

With regard to an ink jet recording material for a non-aqueous ink, which comprises an ink-receiving layer provided on a support and a polymer soluble or swellable in a petroleum type high boiling solvent contained in the ink-receiving layer, it was evident and was proved by comparing Examples 1 to 7 of the present invention with Comparative Examples 1 to 2 which are reworking of Examples of JP-A-10-250218 that an ink jet recording material for a non-aqueous ink excellent in fixing property and ink-absorbing property of a non-aqueous ink could be provided by using a liquid rubber as the above-mentioned polymer. Also, as evident from Examples 5 to 7, a long term preservability (resistance to yellow coloration) of a white paper portion could be improved by using a hydrogenated liquid polyisoprene as a liquid rubber.

The entire disclosure of Japanese Patent Application 11-327836 filed on Nov. 18, 1999 and Japanese Patent Application 2000-325442 filed on Oct. 25, 2000 including specification, claims and summary are incorporated herein by reference in its entirety.

What is claimed is:

1. An ink jet recording material for a non-aqueous ink, comprising an ink-receiving layer provided on a support, the ink-receiving layer being coated or impregnated with a polymer soluble or swellable in a high boiling petroleum solvent, wherein the polymer is a liquid rubber, wherein said liquid rubber is a liquid polyisoprene or a liquid polyisobutylene.

2. The ink jet recording material for a non-aqueous ink according to claim 1, wherein the ink-receiving layer has an outermost layer which is a gloss developing layer and the liquid rubber is impregnated or coated into or upon the gloss developing layer.

3. The ink jet recording material for a non-aqueous ink according to claim 1, wherein the liquid rubber is a liquid polyisoprene.

4. The ink jet recording material for a non-aqueous ink according to claim 1, wherein the liquid rubber is a liquid polyisobutylene.

5. The ink jet recording material for a non-aqueous ink according to claim 1, wherein the liquid rubber is a hydrogenated liquid polyisoprene.

6. The ink jet recording material for a non-aqueous ink according to claim 2, wherein the liquid rubber is a hydrogenated liquid polyisoprene.

7. The ink jet recording material for a non-aqueous ink according to claim 1, wherein the liquid rubber is impregnated into the ink-receiving layer by coating a solution containing the liquid rubber on the ink-receiving layer.

8. The ink jet recording material for a non-aqueous ink according to claim 2, wherein the liquid rubber is impregnated into the ink-receiving layer by coating a solution containing the liquid rubber on the ink-receiving layer.

9. The ink jet recording material for a non-aqueous ink according to claim 3, wherein the liquid rubber is impregnated into the ink-receiving layer by coating a solution containing the liquid rubber on the ink-receiving layer.

10. The ink jet recording material for a non-aqueous ink according to claim 4, wherein the liquid rubber is impregnated into the ink-receiving layer by coating a solution containing the liquid rubber on the ink-receiving layer.

11. The ink jet recording material for a non-aqueous ink according to claim 5, wherein the liquid rubber is impregnated into the ink-receiving layer by coating a solution containing the liquid rubber on the ink-receiving layer.

12. The ink jet recording material for a non-aqueous ink according to claim 6, wherein the liquid rubber is impregnated into the ink-receiving layer by coating a solution containing the liquid rubber on the ink-receiving layer.

* * * * *

UNITED STATES PATENT AND TRADEMARK OFFICE

CERTIFICATE OF CORRECTION

PATENT NO. : 6,616,991 B1
DATED : September 9, 2003
INVENTOR(S) : Uto

It is certified that error appears in the above-identified patent and that said Letters Patent is hereby corrected as shown below:

Title page,
Item [*] Notice, should read:

-- [*] Notice: Subject to any disclaimer, the term of this patent is extended or adjusted under 35 U.S.C. 154(b) by 121 days. --

Signed and Sealed this

Twenty-third Day of November, 2004

JON W. DUDAS
*Director of the United States Patent and Trademark Office*